United States Patent [19]

Webster et al.

[11] Patent Number: 4,787,457

[45] Date of Patent: Nov. 29, 1988

[54] METHOD AND APPARATUS FOR ROTATING CASING STRING SEGMENT

[75] Inventors: Mark B. Webster, 1996 Balearic Dr., Costa Mesa, Calif. 92626; Tom D. Bateman, 263 Ocean View Ave., Newport Beach, Calif. 92663; Trent A. Bateman, 1584 Riverside Pl., Costa Mesa, Calif. 92627

[73] Assignees: Mark B. Webster, Costa Mesa; Tom D. Bateman, Newport Beach; Trent A. Bateman, Costa Mesa, all of Calif. ; a part interest

[21] Appl. No.: 65,021

[22] Filed: Jun. 22, 1987

[51] Int. Cl.[4] ..... E21B 33/14

[52] U.S. Cl. ..... 166/286; 166/50; 166/117.7; 166/173; 166/177; 166/312

[58] Field of Search ..... 166/286, 285, 117.7, 166/242, 50, 78, 104, 177, 208, 170, 172, 173, 312

[56] References Cited

U.S. PATENT DOCUMENTS

| | | | |
|---|---|---|---|
| 2,675,082 | 4/1954 | Hall | 166/285 |
| 2,719,024 | 9/1955 | Prescott et al. | 166/104 |
| 2,876,844 | 3/1959 | Warner | 166/208 X |
| 3,205,945 | 9/1965 | Holt | 166/104 X |
| 3,828,852 | 8/1974 | Delano | 166/78 |
| 4,010,804 | 3/1977 | Garcia | 166/208 X |
| 4,239,083 | 12/1980 | Silberman et al. | 166/117.7 |

FOREIGN PATENT DOCUMENTS

| | | | |
|---|---|---|---|
| 2172633 | 9/1986 | United Kingdom | 166/285 |

OTHER PUBLICATIONS

Lindsey, Jr., "Rotate Liners for a Successful Cement Job", World Oil, Oct. 1986.

*Primary Examiner*—Hoang C. Dang

*Attorney, Agent, or Firm*—Fulwider, Patton, Rieber, Lee & Utecht

[57] ABSTRACT

A method and apparatus for rotating a portion or segment of a casing string in a relatively highly deflected well bore. A straight well bore portion is provided adjacent the completion interval, beyond the deflected portion. A casing string is made up with a segment connected by a swivel to the remainder of the string. This segment is located in the straight portion of the bore. A drill string is lowered into the casing into engagment with a rotatable swivel portion fixed to the casing segment. The drill string is rotated to rotate the casing segment independently of the remainder of the casing string. This facilitates removal of excess mud cake from the annulus adjacent the casing segment, and also placement of cement in the annulus.

16 Claims, 2 Drawing Sheets

FIG. 3
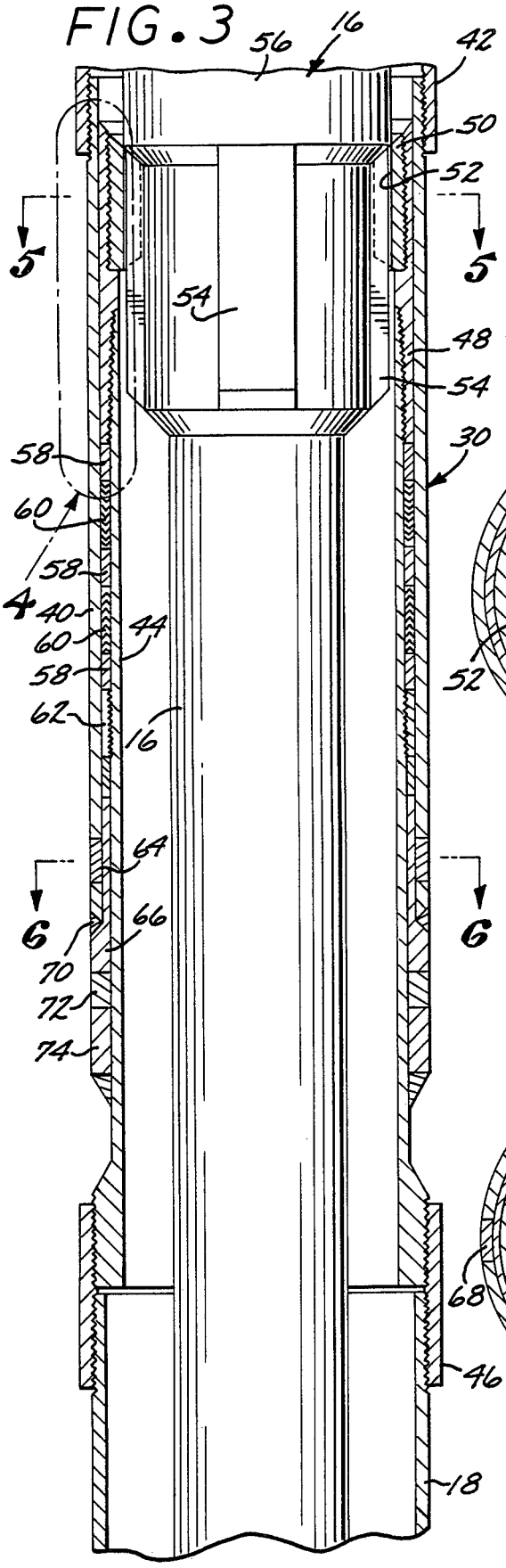
FIG. 4
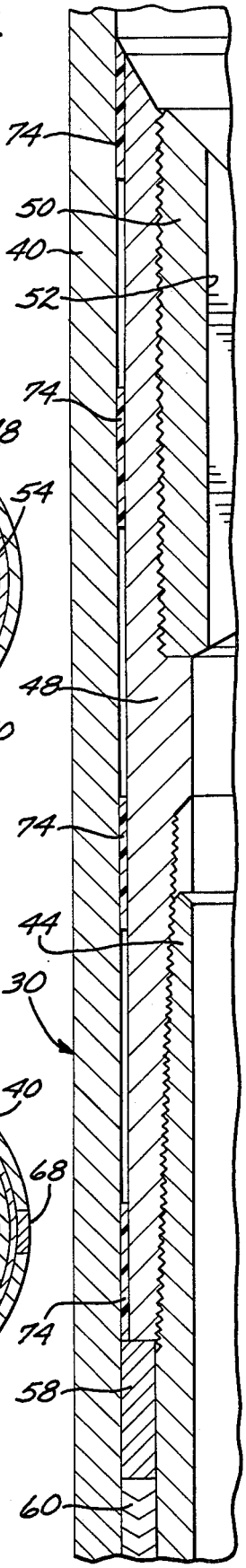
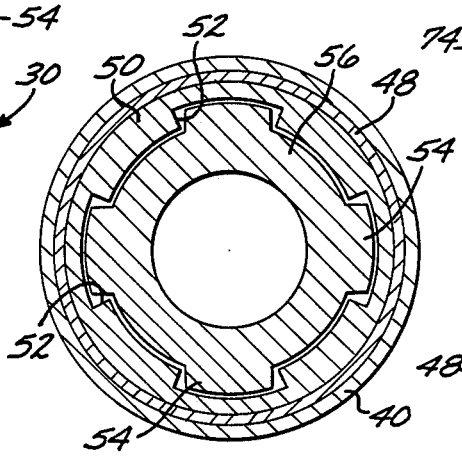
FIG. 5
FIG. 6
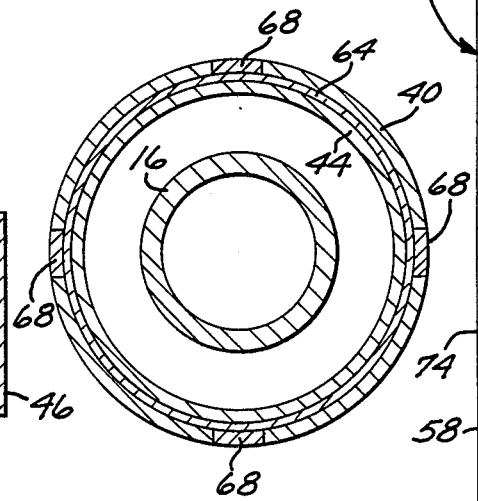

METHOD AND APPARATUS FOR ROTATING CASING STRING SEGMENT

BACKGROUND OF THE INVENTION

Field of the Invention

The present invention relates to a method and apparatus for rotating a casing string in a well bore, and more particularly for rotating a segment of a casing string in a relatively highly deflected well bore.

Description of Related Art

The excess drilling mud cake which builds up on the walls of a well bore during drilling must be removed prior to cementing of the casing. It is common practice to do this by lowering the casing string into the drilled well bore until a cement shoe on the string seats upon the bottom of the bore hole. Clean drilling mud is then circulated at a relatively high rate through the casing, out of the cement shoe, and upwardly through the annulus between the casing and the well bore. Centralizers along the length of the casing string engage the well bore walls and attempt to center the casing to define a uniform annular flow area in a plane perpendicular to the direction of mud flow. This equalizes pressure distribution and flow resistance around the casing and facilitates displacement of the drilling mud. However, the clean drilling mud tends to form channels in the gelatinous, rubberlike mud cake in the annulus. If such channels were allowed to remain, the subsequently injected cement slurry would follow these channels. Eventually the mud cake between the resulting cement channels could erode away and permit communication of fluid and/or gas to the surface.

Successful removal of excess mud cake has been accomplished by mounting scratchers, turbulators and the like to the casing exterior. These frictionally engage the well bore surfaces. Suitable means are then employed to rotate the casing so that such devices brush or wipe against the mud filter cake and break the gel. The circulating clean mud can then completely scour out the well bore by carrying away the excess mud cake and loose formation materials.

After the bore hole has been circulated with clean drilling mud for a period of time, the cement slurry is introduced into the well bore annulus by passing it through the casing string and out of the cementing shoe at the bottom. Rotation of the casing string is continued during placement of the slurry to agitate the slurry and achieve uniform distribution of the slurry throughout the annulus. The cement sheath which results is absent any continuous channels of drilling mud which might erode away during well treatment and production. U.S. Pat. No. 3,828,852, issued Aug. 13, 1974 to C. G. Delano is illustrative of the foregoing method.

The foregoing system for rotating a casing string is not possible in a relatively high angle or highly deflected well bore. If a sufficient number of centralizers were used to center the casing throughout its length, the friction between the centralizers and the bore hole walls would ultimately prevent insertion of the casing. Without such centralizers the casing sags into engagement with the well bore walls at high angle bends and frictional forces then exist which are so great that the casing string cannot be rotated. This results in an inferior placement of cement and expensive and time consuming squeeze procedures must be adopted. Many wells are slant drilled, particularly in offshore waters, and the establishment of a cement sheath or seal of high integrity is critical to prevent catastrophic pressure releases.

SUMMARY OF THE INVENTION

According to the present invention, only a portion or segment of the casing string in a highly deflected or slant drilled well bore is rotated. The segment rotated is located in a relatively straight portion of the bore which is provided beyond the deflected portion. This portion is drilled adjacent the producing formation, and an effective cement seal in this area is critical. A less effective seal in the casing string above that point can generally be tolerated, particularly since it is customary and relatively easy to provide a cement seal at the upper end of the well bore adjacent the surface.

The rotatable casing segment includes a conventional cementing shoe, stab through float collar, centralizers, scratchers and turbulators. A specially designed swivel is carried by the casing segment to permit rotation relative to the upper part of the casing string. A centralizer is used above the swivel to keep the swivel off the well bore walls. The swivel comprises a stationary portion fixed to the casing string upper part, and a rotatable portion fixed to the rotatable segment. Sealing means and bearing means between the swivel portions prevent fluid leakage along the swivel walls and facilitate rotation, respectively. A drive means on the rotatable portion of the swivel is engagable by a drill string tool for rotation by a drill string lowered into the casing string.

The method of the invention comprises rotating the end portion or segment of the casing string in a relatively straight portion of the well bore located adjacent the deflected or slant portion of the well bore, the slant portion being the portion of the bore hole which prevents rotation of the full length of the casing string. During segment rotation to scour away excess mud cake, clean drilling mud is circulated through the well bore annulus, followed by injection of the cement slurry. The method results in a uniformly continuous cement seal in the annulus adjacent the producing or completion interval.

Other objects and features of the invention will become apparent from consideration of the following description taken in connection with the accompanying drawings.

BRIEF DESCRIPTION OF THE DRAWINGS

FIG. 3 is an enlarged view taken along the line 3—3 of FIG. 1;

FIG. 4 is an enlarged view of the structure indicated by the numeral 4 in FIG. 3;

FIG. 5 is a view taken along the line 5—5 of FIG. 3; and

FIG. 6 is a view taken along the line 6—6 of FIG. 3.

DESCRIPTION OF THE PREFERRED EMBODIMENT

Figures 1, 2:
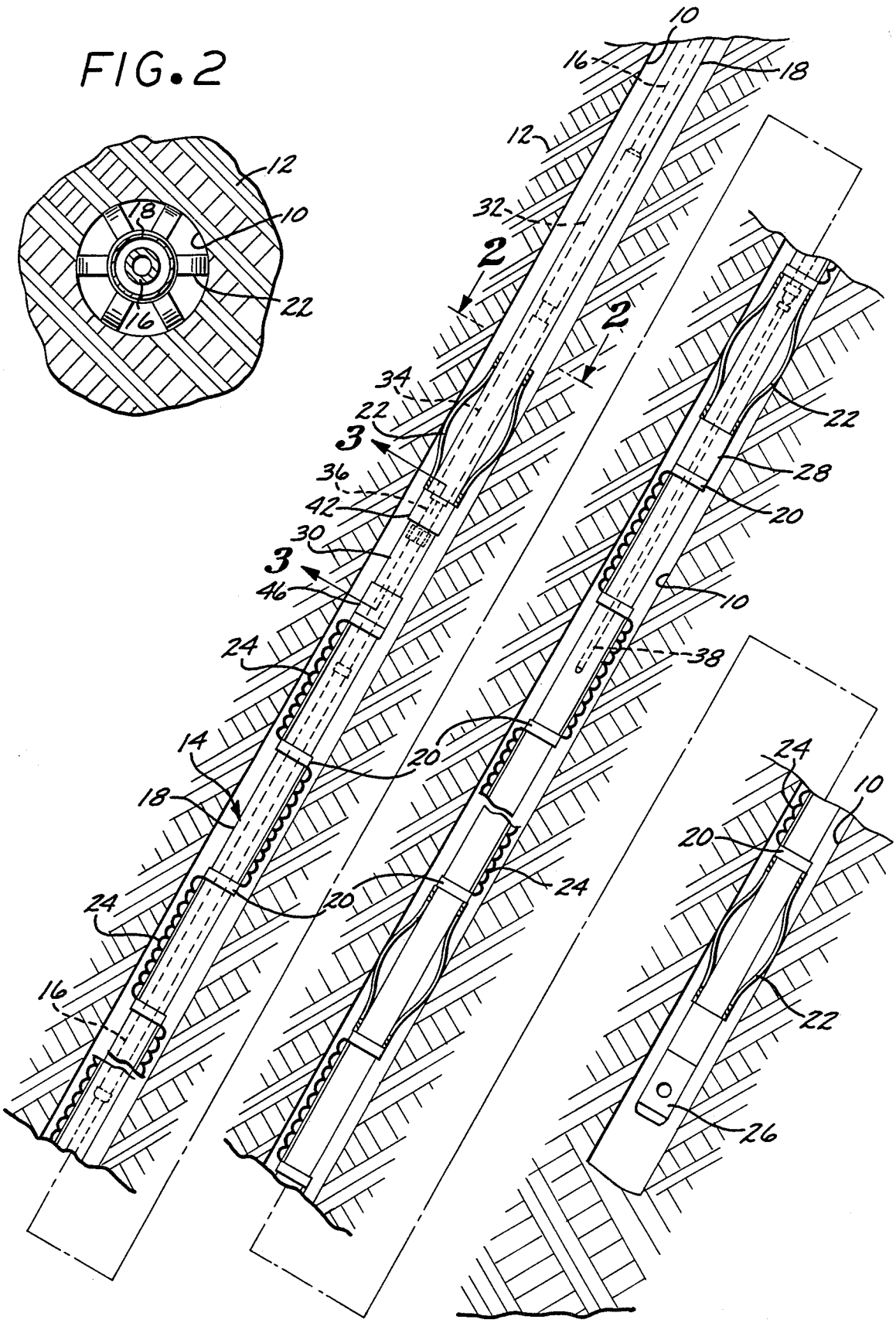
FIG. 1 is a diagrammatic showing of casing and tool strings arranged according to the present invention in a relatively straight portion of a highly deflected or slanted well bore.
FIG. 2 is an enlarged view taken along the line 2—2 of FIG. 1.

With reference to FIGS. 1 and 2, the well bore portion 10 illustrated is the lower part of a relatively highly deflected or slant drilled well bore. The upper, highly deflected and much longer part of the well bore is omitted to conserve drawing space.

It is not uncommon for a well bore to be deflected as much as sixty degrees, and sometimes even to ninety degrees or horizontal. This makes rotation of the complete length of a casing string impossible. According to the present invention, the portion of the well bore just above the producing interval is drilled to provide the straight portion 10. The term "straight" is used for convenience to designate a rotation enabling portion of a well b it is in this portion 10 that a casing segment 14 is rotated to make possible the placement of a concrete seal or sheath for pressure isolation between the producing interval of the penetrated formation 12 and the surface.

The casing segment 14 comprises a plurality of cylindrical joints 18 threadably connected together by casing collars 20. The segment 14 carries a plurality of centralizers 22 and scratchers or turbulators 24, a float collar and cement shoe 26 at its lower end, and a stab-in float collar 28. All of these components are conventional and well known in the art and form no part of the present invention. The casing segment 14 also includes a special swivel 30 permitting rotation of the segment relative to the upper part of the casing string.

A drill string 16 made up for lowering into the casing string includes a number of conventional components for pumping drilling mud and cement, including a plug catcher 32, a bumper sub 34, a drive sub 36, and a stinger 38 which is insertable through the float collar 28. Details of these items and others associated with drill rigs, such as the rotary table, draw works, plug releasing head and the like (not shown), are omitted for brevity inasmuch as they form no part of the present invention.

To give some idea of the relative size and relationship of the components illustrated, the casing string in a typical recent installation included one hundred and thirty nine casing joints 18 extending from the surface to a depth of 5,874 feet. The stab-in float collar 28 was located at 5,786 feet, and the casing swivel 30 was located at 5,477 feet on top of the tenth casing joint. The stab-in float collar 28 was located two joints above the shoe 26, and centralizers 22 were located above the float collar and shoe 26, at the middle of the first casing joint, at the first casing collar 20, at the middle of the second casing joint 18, above the stab-in collar 28, at every collar up to the swivel 30, at the collar 20 above the swivel 30, and at every other collar 20 to a depth of 4,442 feet. The scratchers or turbulators 24 were placed substantially continuously from the shoe 26 to the swivel 30, avoiding the collars 20 and centralizers 22. The casing segment 14 was comprised of a nine foot long swivel 30 and ten casing joints 18. Of course, the number, character and arrangement of the various components will vary according to the particular application.

FIGS. 3 through 6 illustrate the swivel 30 in greater detail. Although other types of swivel may be used, the swivel 30 has been found to operate satisfactorily. Swivel 30 includes a stationary sleeve or portion 40 having a threaded upper extremity which is connected by an internally threaded collar 42 to the casing string joints above the swivel 30.

The swivel 30 also includes a rotatable sleeve or portion 44 located interiorly of the stationary portion 40. An externally threaded lower extremity of portion 40 is threadably connected to the casing string joints 18 below 30 by means of an internally threaded collar 46.

The upper extremity of the rotatable portion 44 is externally threaded a fit within an internally threaded collar 48 which threadably receives a spline drive 50. The longitudinally oriented channels or splines 52 of drive 50 longitudinally slidably receive complemental projections or lugs 54 of a spline drive segment 56 forming a part of the drive stub of the drilling string 16. As will be seen, this arrangement permits the drill string to engage the swivel for rotating the casing segment 14.

Bearing and sealing means are provided to facilitate relative rotation between the swivel portions 40 and 44, and to maintain of a fluid tight seal at all times. The bearing means comprises a plurality of longitudinally spaced bronze bushings or rings 58 located in an annulus defined between the swivel portions 40 and 44, while the sealing means comprise chevron packings or seals 60 between adjacent rings 58. The chevron seals 60 are longitudinally compressed on making up the swivel by means of an internally threaded bushing 62. The bushing 62 is mounted on an externally threaded portion of the rotatable portion 44 and is tightened to compress the seals against the adjacent walls of the swivel portions 40 and 44.

The annulus receiving the rings 58 and seals 60 is defined by a cylindrical sleeve or spacer 64 having a base 66 whose external diameter approximates that of the adjacent stationary portion 40. The portion 40 is rigidly secured to the spacer 64 and base 66 by four circumferentially spaced plug welds 68 and by a base weld 70, respectively.

A bronze ring 72 is disposed between adjacent portions of spacer base 66 and a bottom abutment collar 74 welded to the outside of swivel portion 44, facilitating relative rotation between these parts. As best seen in FIG. 4, a plurality of longitudinally spaced apart low friction bands or bushings 74 are located between the collar 48, which is rotatable with the spline portion 44, and the spline stationary portion 40, also facilitating relative rotation.

In operation, the lower extremity of the well bore is drilled to provide a well bore 10 that is relatively straight and without bends adjacent the producing interval. The casing string is then run into the hole until the cement shoe 26 is at or adjacent the bottom. The casing string is hung in a conventional manner, and the drill string 16 is then run inside the casing. During this operation, the stinger 38 penetrates the stab- through float collar 28 in sealing relation, and the drill string drive segment 56 engages the drive 50 of the rotatable spline portion 44.

The centralizers 22 on the casing segment 14 center the segment in the bore 10 and space the swivel 30 away from the walls of the well bore. The drill string 16 is then rotated from the surface by usual means to thereby rotate the casing segment 14. During segment rotation clean drilling mud is pumped down the drill string 16 and out of the cement shoe 26 into the well bore annulus. The turbulators 24 abrade away excess mud cake and loose formation material which is then carried to the surface by the clean drilling mud. Mud circulation is continued until the bore hole 10 is thoroughly scoured.

Conventional procedures are next followed to terminate the circulation of mud, place a mud/cement interface plug, and initiate pumping of cement slurry through the drill string, into the casing segment 14, out of the shoe 26 and upwardly through the well bore annulus. This is continued until the desired column of cement has been placed. The casing segment 14 is rotated contemporaneously with pumping of the cement slurry to cause the turbulators 24 to sweep through the well bore annulus and uniformly disperse the cement in the annulus adjacent the casing segment 14. Conventional procedures are then followed to complete the well, as will be apparent to those skilled in the art.

The foregoing method and apparatus have been found to produce a structurally continuous cement seal or sheath providing excellent isolation between the producing or completion interval and the surface. The method and apparatus of the invention is also adapted to provide a similar seal or sheath in portions of a highly deflected well bore other than the portion adjacent the completion interval. Wherever it is important to provide pressure isolation between portions of a well bore, or between a portion of a well bore and the surface, and it is not possible to rotate the complete casing string, the present method and apparatus can be utilized to rotate a segment of the casing string to provide a reliable seal adjacent that segment.

Various modifications and changes may be made with regard to the foregoing detailed description without departing from the spirit of the invention.

We claim:

1. A method of rotating a segment of a casing string extending from the surface into a well bore having a relatively highly deflected well bore portion, the method comprising the steps of:

providing a rotation enabling portion in the well bore beyond the deflected well bore portion;

making up a casing string having a swivel between a segment of the string and an adjacent portion of the string to render the casing segment rotatable relative to the adjacent portion of the string, and wherein the segment and the adjacent portion of the string have substantially the same external diameter;

running the casing string into the well bore and locating the casing segment in the rotation enabling portion of the well bore;

running a drill string through the casing string and into driving engagement with the swivel; and rotating the drill string to rotate the casing segment relative to the adjacent portion of the casing string.

2. The method of claim 1, and further comprising the steps of:

passing drilling mud down the drill string, out of the casing segment and into the annulus between the well bore and the casing segment during rotation of the casing segment.

3. The method of claim 2, and further comprising the steps of:

terminating the passage of drilling mud down the drill string; and passing a cement slurry down the drill string, out of the casing segment and into the annulus during rotation of the casing segment.

4. The method of claim 3, and further comprising the step of terminating the flow of cement slurry when the slurry reaches a predetermined point within the annulus.

5. In combination with a casing string having an upper part located in a relatively highly deflected portion of a well bore and extending upwardly to the surface, and further having a segment of substantially the same external diameter as the upper part located in a rotation enabling portion of the well bore beyond the deflected portion, apparatus for rotating the casing segment comprising:

a swivel between the casing segment and the upper part of the casing string, the swivel including a stationary portion fixed to the upper part and a rotatable portion fixed to the casing segment; sealing and bearing means disposed between the stationary and rotatable portions and enabling fluid tight relative rotation therebetween; and drive means fixed to the rotatable portion and engagable by a drill string for rotation of the rotatable portion to rotate the casing segment relative to the upper part of the casing string above the casing segment.

6. Apparatus according to claim 5 and including centralizer means mounted to the casing string adjacent the swivel and operative to maintain the swivel in spaced relation to the adjacent well bore walls.

7. Apparatus according to claim 5 and including means on the swivel enabling passage of fluid material from the drill string, through the swivel, and to the casing segment for passage out of the casing segment and into the annulus during rotation of the casing segment.

8. Apparatus according to claim 7 including means on the casing segment comprising elements for sweeping through the annulus and engaging the adjacent well bore walls during rotation of the casing segment.

9. Apparatus according to claim 7 and including centralizer means mounted to the casing segment and operative to center the casing segment in the well bore to facilitate the circulation of fluid material.

10. In a casing string having an upper part located in a relatively highly deflected portion of a well bore characterized by walls and extending upwardly to the surface, and further having a segment of substantially the same external diameter as the upper part located in a rotation enabling portion of the well bore beyond the deflected portion, apparatus for rotating the casing segment and circulating fluid material into the annulus between the well bore and the casing segment, the apparatus comprising:

a swivel between the casing segment and the upper part of the casing string, the swivel including a stationary portion fixed to the upper part and a rotatable portion fixed to the casing segment; sealing and bearing means disposed between the stationary and rotatable portions and enabling fluid tight relative rotation therebetween; and drive means fixed to the rotatable portion and engagable by a drill string for rotation of the rotatable portion to rotate the casing segment relative to the upper part of the casing string;

means on the casing segment extending into the annulus for sweeping through the annulus and engaging the adjacent well bore surfaces during rotation of the casing segment;

centralizer means mounted to the casing string adjacent the swivel and tending to maintain the swivel in spaced relation to the adjacent well bore walls; and means on the swivel enabling passage of fluid material from the drill string, through the swivel, and to the casing segment for passage out of the casing segment and into the annulus during rotation of the casing segment.

11. A method of rotating a segment of a casing string extending from the surface into a well bore having a relatively highly deflected well bore portion, the method comprising the steps of:

providing a rotation enabling portion in the well bore beyond the deflected well bore portion;

making up a casing string having a swivel between a segment of the string and the remainder of the string to render the casing segment rotatable relative to the remainder of the string;

running the casing string into the well bore in spaced relation to the well bore sufficient to provide a drilling mud passage along the exterior of the casing segment and the remainder of the sting for carrying drilling mud to the surface, and locating the casing segment in the rotation enabling portion of the well bore;

running a drill string through the casing string and into driving engagement with the swivel;

rotating the drill string to rotate the casing segment relative to the remainder of the casing string; and passing drilling mud down the drill string, out of the casing segment and into the drilling mud passage during rotation of the casing segment.

12. The method of claim 11, and further comprising the steps of:

terminating the passage of drilling mud down the drill string; and passing a cement slurry down the drill string, out of the casing segment and into the drilling mud passage during rotation of the casing segment.

13. In combination with a casing string having an upper part located in a relatively highly deflected portion of a well bore and extending upwardly to the surface, and further having a segment located in a rotation enabling portion of the well bore beyond the deflected portion, and wherein the upper part and the segment of the casing string are spaced from the well bore sufficiently to provide a drilling mud passage along the exterior of the casing string for carrying drilling mud to the surface, apparatus for rotating the casing segment comprising:

a swivel between the casing segment and the upper part of the casing string, the swivel including a stationary portion fixed to the upper part and a rotatable portion fixed to the casing segment; sealing and bearing means disposed between the stationary and rotatable portions and enabling fluid tight relative rotation therebetween; and drive means fixed to the rotatable portion and engagable by a drill string for rotation of the rotatable portion to rotate the casing segment relative to the upper part of the casing string above the casing segment.

14. Apparatus according to claim 13 and including means on the swivel enabling passage of drilling mud through the drill string to the casing segment for passage out of the casing segment and into the drilling mud passage during rotation of the casing segment.

15. In combination with a casing string having an upper part located in a relatively highly deflected portion of a well bore characterized by walls and extending upwardly to the surface, and further having a segment located in a rotation enabling portion of the well bore beyond the deflected portion, and wherein the upper part and the segment of the casing string are spaced from the well bore sufficiently to provide a drilling mud passage along the exterior of the casing string for carrying drilling mud to the surface, apparatus for rotating the casing segment and circulating fluid material into the drilling mud passage between the well bore and the casing segment, the apparatus comprising: a swivel between the casing segment and the upper part of the casing string, the swivel including a stationary portion fixed to the upper part and a rotatable portion fixed to the casing segment; sealing and bearing means disposed between the stationary and rotatable portions and enabling fluid tight relative rotation therebetween; and drive means fixed to the rotatable portion and engagable by a drill string for rotation of the rotatable portion to rotate the casing segment relative to the upper part of the casing string;

means on the casing segment extending into the drilling mud passage for sweeping through the drilling mud passage and engaging the adjacent well bore surfaces during rotation of the casing segment;

centralizer means mounted to the casing string adjacent the swivel and tending to maintain the swivel in spaced relation to the adjacent well bore walls; and means on the swivel enabling passage of fluid material from the drill string, through the swivel, and to the casing segment for passage out of the casing segment and into the drilling mud passage during rotation of the casing segment.

16. A method of rotating a segment of a casing string extending from the surface into a well bore having a relatively highly deflected well bore portion, the method comprising the steps of:

providing a rotation enabling portion in the well bore beyond the deflected well bore portion;

making up a casing string which is structurally continuous along its exterior surfaces to define a drilling mud passage between the casing string and the well bore for carrying fluid materials to the surface along the exterior of the casing string, and providing a swivel between a segment of the string and an adjacent portion of the string to render the casing segment rotatable in the rotation enabling portion of the well bore, and relative to the adjacent portion of the string;

running the casing string into the well bore and locating the casing segment in the rotation enabling portion of the well bore;

running a drill string through the casing string and into driving engagement with the swivel; and rotating the drill string to rotate the casing segment relative to the adjacent portion of the casing string.

* * * * *

UNITED STATES PATENT AND TRADEMARK OFFICE

CERTIFICATE OF CORRECTION

PATENT NO. : 4,787,457

DATED : November 29, 1988

INVENTOR(S) : Mark B. Webster, et al.

It is certified that error appears in the above-identified patent and that said Letters Patent is hereby corrected as shown below:

Column 3, line 9, delete "b" and insert --bore. As will be seen,--;

line 68, after "below" insert --the swivel--;

Column 4, line 7, delete "drilling" and insert --drill--.

Signed and Sealed this

First Day of August, 1989

*Attest:*

*Attesting Officer*

DONALD J. QUIGG

*Commissioner of Patents and Trademarks*